United States Patent [19]

Camps et al.

[11] Patent Number: 4,777,527

[45] Date of Patent: Oct. 11, 1988

[54] MOVING VIDEO SURVEILLANCE SYSTEM

[75] Inventors: Robert Camps, Paris, France; Saïd Moudir, Berne, Switzerland

[73] Assignee: Compagnie Generale D'Automatisme CGA-HBS, France

[21] Appl. No.: 945,703

[22] Filed: Dec. 23, 1986

[30] Foreign Application Priority Data

Dec. 30, 1985 [FR] France ..... 85 19582

[51] Int. Cl.[4] ..... H06N 7/18; H06N 5/33

[52] U.S. Cl. ..... 358/108; 358/113; 104/138.1

[58] Field of Search ..... 358/108, 112, 113, 229; 104/138.1, 138.2, 139, 155

[56] References Cited

U.S. PATENT DOCUMENTS

| | | | |
|---|---|---|---|
| 4,027,329 | 5/1977 | Coutta | 358/108 |
| 4,120,004 | 10/1978 | Couta | 358/108 |
| 4,326,218 | 4/1982 | Coutta et al. | 358/108 |
| 4,337,482 | 6/1982 | Coutta | 358/108 |
| 4,347,791 | 9/1982 | Mandros | 104/138.1 |
| 4,510,526 | 4/1985 | Coutta et al. | 358/108 |

FOREIGN PATENT DOCUMENTS 589991 4/1975 Switzerland .

*Primary Examiner*—James J. Groody
*Assistant Examiner*—John K. Peng
*Attorney, Agent, or Firm*—Sughrue, Mion, Zinn, Macpeak, and Seas

[57] ABSTRACT

A surveillance system in which a video camera (7) is displaceable inside a transportation tube (1) along any direction in three-dimensional space under the effect of a compressed fluid. The transportation tube (1) is provided with at least one longitudinally-extending transparent observation window (2). The camera (7) is contained in a displaceable "torpedo" (8) and has its optical axis running parallel to the axis of the tube (1), and it receives images through the window (2) by means of a mirror (11) having two faces at an angle with the common edge running vertically and intersecting the optical axis (12), thus enabling the camera to transmit simultaneous left and right looking images to a central control station by a microwave beam.

7 Claims, 1 Drawing Sheet

MOVING VIDEO SURVEILLANCE SYSTEM

Security and/or safety considerations can make it necessary to perform surveillance of places where dangerous or other unwanted events may take place, for example surveillance of fire risks, surveillance of theft or damage in public or private premises, and surveillance of activities which can lead to accidents in factories, on work sites, or on the roads.

BACKGROUND OF THE INVENTION

Presently known surveillance means include detectors in communication with visual or audio output devices for delivering signals from said detectors to alert personnel responsible for taking action under appropriate circumstances, or which are in direct communication with protection devices which are brought into operation automatically, for example sprinklers for sprinkling water or some other product for fire-fighting purposes, or devices for ejecting a gas to hinder the destructive acts of vandals.

Such detectors may be thermal detectors which respond to temperature, electronic detectors which respond to infrared radiation, to ultrasonic waves, or to radar emissions for detecting displacement within a monitored volume. Detectors are sometimes accompanied by means for instantly displaying the place under surveillance, using a video camera or micro-camera connected to a monitor screen.

Regardless of the effective range of any such surveillance device, and regardless of its angle of observation, the area or volume over which any one device is effective is always limited. This remains true even when such devices are rotatable about an axis in order to increase their effective range by a rotating or scanning action.

Such devices can be made effective over a larger area by multiplying the number of devices, thereby increasing expense, even if individual devices are cheap, which is not always the case.

An object of the present invention is thus to increase the field of observation of a given surveillance device in a manner which may be practically unlimited.

SUMMARY OF THE INVENTION

This is achieved by making the surveillance device displaceable by translation parallel to its axis over distances which are limited by the same limits as define the space to be monitored regardless of the length thereof and instead of rotating the device in a horizontal plane. If the surveillance device is a video camera, for example, various means may be used to propell it along the inside of a tube having at least one longitudinally-extending portion of its wall which is transparentin order to allow constant observation by the camera over its entire travel inside the tube, with the camera being capable of going round such curves as may exist in the path of the tube.

Such a device can thus advantageously be used for surveillance of large-sized premises and can even be used for road surveillance to observe road surface states, traffic density, the behavior of individual drivers, the site and sometimes even the circumstances of an accident, or the circumstances which have led to an accident.

BRIEF DESCRIPTION OF THE DRAWING

An embodiment of the invention is described by way of example with reference to the accompanying drawing, in which.

MORE DETAILED DESCRIPTION

Figure 2:
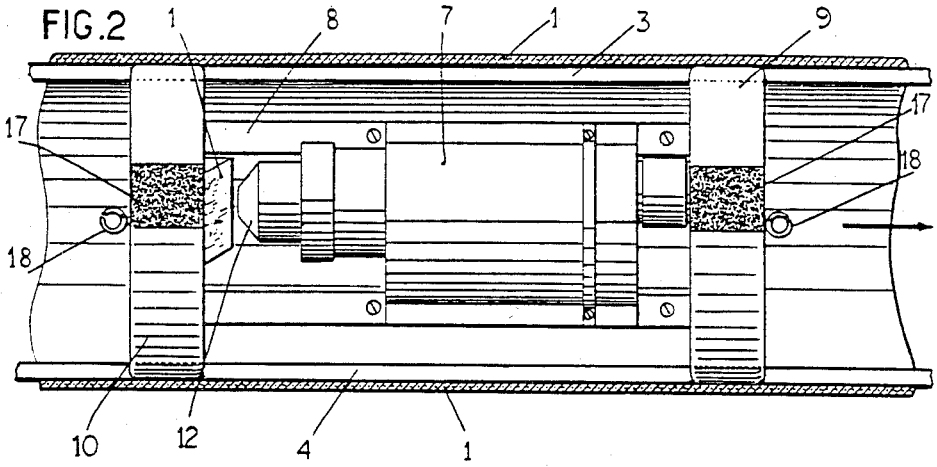
FIG. 2 is a diagrammatic longitudinal section on a diameter of a length of tube containing a surveillance member, and in particular a miniature video camera capable of moving along the inside of said tube.
Figure 1:
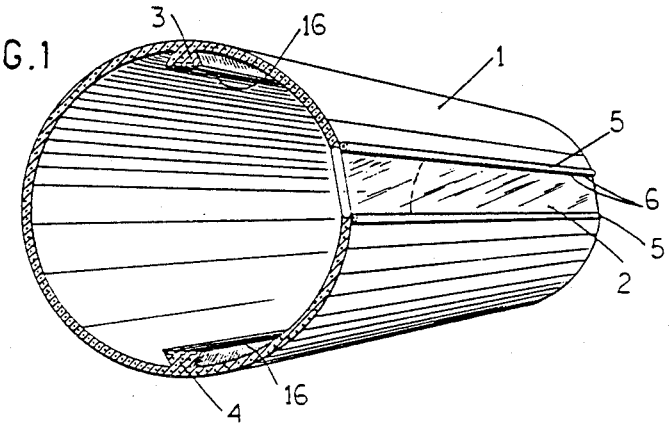
FIG. 1 is a diagrammatic perspective view of a length of transportation tube capable of receiving a surveillance member and of guiding its displacement.

As shown in the drawing, the transportation tube 1 is constituted by a closed polygonal or cylindrical tube of rigid electrically-insulating material and provided over at least a portion of at least one side with a longitudinally-extending transparent wall or window 2 constituted by a plane parallel-faced strip (in order to avoid optical deformation), with the longitudinally-extending edges of the transparent wall being sealed in air-tight manner to the remainder of the tube over the entire length thereof.

A surveillance device, such as a miniature video camera 7, is moved along the inside of the tube on a carrier or "torpedo" 8 and provides a surveillance function by looking out from the tube, through the window(s) 2.

The inside of the transportation tube 1 is provided with prismatic rails 3 and 4 which are fixed to its inside wall and which run along opposite ends of a diameter orthogonal to a diametrical plane containing the longitudinal window(s). Each of said rails is made of an electrically-insulating material, which may be identical to or different from the electrically-insulating material from which the tube is made, and serves to guide the torpedo 8.

The prismatic rails 3 and 4 which run along diametrically-opposite internal generator lines of the tube over its entire length have metal strips 16 running along one or more of their faces, with sufficient strips 16 being provided to transmit the various electrical signals which are required for driving and operating the camera 7 as it runs along the conductor tube, and maybe to provide other functions as well.

Cleaning-fluid pipes 5 run along the top and bottom edges of the transparent surface 2 and on the outside of the tube 1. These pipes 5 are perforated by multiple small holes 6 which are close together such that the jets of liquid under pressure which escape therefrom in the form of a spray cover respective areas which overlap the areas covered by the adjacent holes so that the entire surface of the window 2 is reached by jets from said holes 6.

The said window(s) 2 can thus be cleaned by means of an external brush mounted on a magnetic support and driven along the tube 1 by a torpedo 8 having a strong permanent magnet fixed thereto.

The surveillance device shown which moves along the inside of the transportation tube 1 is a miniature video camera 7 fixed inside the torpedo 8 which has front and rear ends 9 and 10 made of respective disks of self-lubricating plastic, e.g. polytetrafluoroethylene. The disks run along the inside wall of the cylinder 1 as a snug fit in order to provide sufficient sealing to enable them to act as a piston which is driven along the tube 1 pneumatically.

The objective lens 12 of the camera 7 points towards the rear of the torpedo 8 and its optical axis is parallel to the axis of the conductor tube 1. The camera 7 is sensitive to infrared radiation so as to make observation possible at night.

A reflecting angle block 11 having a vertical edge intersecting the optical axis 12 of the camera is disposed behind the camera and has plane mirrors looking out sideways from the torpedo to enable the camera lens to receive simultaneous or alternating images from the, or each, longitudinal window 2 of the tube 1.

Figure 3B:
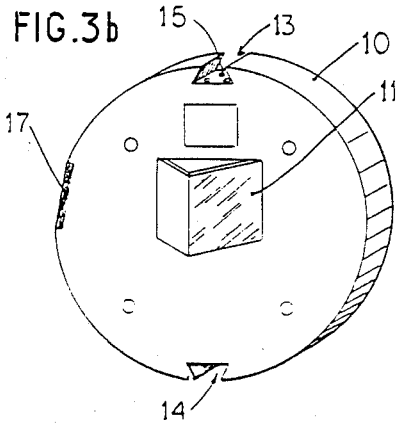
FIGS. 3*a* and 3*b* are diagrammatic perspective views of disks used for propelling the moving assembly, with FIG. 3*a* being a front view and FIG. 3*b* being a rear view.
Figure 3A:
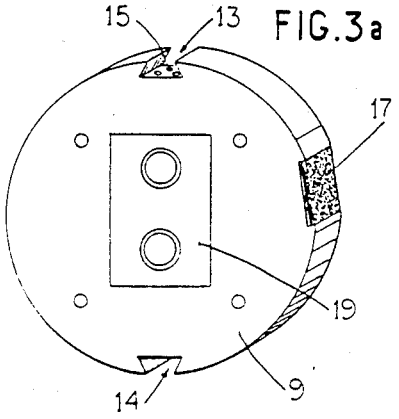

The camera assembly is guided along the inside of the tube 1 by rail-receiving slots 13 and 14 (see FIGS. 3*a* and 3*b*) provided for this purpose in the periphery of each of the self-lubricating disks 9 and 10.

An adequate number of resilient metal contacts 15 are provided in each of the slots 13 and 14 so as to remain constantly in contact with corresponding ones of the conductor strips 16. Said contacts serve to transmit the necessary electric pulses to devices inside or outside the camera 7 for ensuring that the camera 7 performs all the necessary functions both internally and externally for proper operation of the assembly and for instantaneously transmitting images or other signals created thereby.

The end disks 9 and 10 are also provided level with the transparent surfaces 2 of the tube 1 with respective cleaning pads 17 which remain constantly in contact with the inside surface of the, or each, window 2 of the conductor tube.

Finally, hooks 18 are situated at opposite ends of the camera torpedo 8 for coupling together one or more torpedoes for simultaneous displacement along the tube.

The camera torpedo 8 is capable of running along the inside of the tube 1 along its entire length regardless of whether it is disposed rectilinearly or around curves, provided that the curves have a radius of curvature which is compatible with the length of the camera torpedo 8.

Drive may be provided by dry filtered compressed gas, for example air, with a suitable compressor system being disposed to apply a pressure difference across the torpedo 8. High pressure may be applied to the rear 10 of the torpedo 8, or low pressure may be applied to its front 9, or both high and low pressure may be applied simultaneously.

Alternatively, the torpedo 8 may be magnetically-propelled by means of a linear motor whose inductor is disposed inside one or other of the rails 3 and 4.

Over short distances, the torpedo 8 may be propelled by applying pressure to a liquid. This provides slower movement but improved sealing around the disks 8 and 9, thereby providing better energy efficiency.

Over even shorter distances, the torpedo 8 may be propelled by a set of two flexible cords operated by winches situated at the ends of the tube 1 and connected to the hooks 18 of the torpedo, thereby enabling it to move back-and-forth in each direction.

In some circumstances it may even be possible to move the torpedo 8 by rotating a longitudinally-extending lead screw which passes along the inside of the tube 1 and successively through both of the disks 9 and 10 which are then fitted with appropriate nuts, with the assembly being moved in one direction or the other by rotating the lead screw in an appropriate direction.

A motor responsive to electrical control pulses conveyed via the metal strips 16 can be used to point the reflecting faces of the angle member 11 so as to enable the lens 12 whose axis lies parallel to the axis of the tube 1 to receive images over a field which extends in a vertical plane orthogonally to the axis of the apparatus, thereby enabling the lens 12 to simultaneously or alternately receive images observed on either side of the tube 1 through the or each window 2.

The images thus received by the camera may be transmitted by a microwave beam, using an electronic assembly 19 contained in one or other of the disks 9 and 10 (see FIG. 3). The message delivered by the electronic assembly 19 is conveyed either by a microwave beam or else by metal strips 16 in the form of a UHF video signal, and is received by monitor screens in a central observation position. Alternatively, the signal may be a digital signal for application to computers, or a digitized video signal, depending on surveillance requirements.

Over short distances, for which the tube 1 may be rectilinear, the signals may alternatively be transmitted by a modulated laser beam transmitted from a device contained in the torpedo 8.

It is advantageous to transmit messages in the form of binary signals since that enables the received image to be immediately compared with a standard image contained in a computer memory, and since that also makes it possible to immediately transmit an instruction which is the direct consequence of the observed differences or coincidences between the received image and the stored image.

This technique can be used to provide highly effective surveillance of a road.

For example, supposing a central computer memory has stored images of a road under fog, or of a wet road, or of a snow-covered road, it is then easy for the computer to compare its stored images with images received from a camera running along the tube 1 placed along the side of a motorway and for the computer to immediately transmit instructions so that the appropriate safety measures are taken whenever it detects coincidence.

It is then advantageous for the tube 1 to include periodically-disposed transmitters in known locations for transmitting coded signals received from the camera as it passes each of said transmitters, thereby enabling the central computer and a display monitor to accurately situate the location of the camera when transmitting a given image, and even to follow the camera on said screen.

When necessary, the torpedo 8 may be stopped at any given point of the circuit along which it travels whenever an event is observed in the central control station, for example by switching off the air flow, in order to allow an event to be continuously monitored (for example an accident and the consequences thereof).

The outside pipes 5 with their holes 6 are used to spray cleaning liquid on the outside face of the transparent wall 2.

When the system is used for surveillance over large distances, for example along motorways, it may comprise a pair of single-window tubes 1 running along each of the outside edges of the motorway, or it may comprise a single, two-window tube running along the central reservation. In either case, the system is organized in the same way as a conventional pneumatic letter-carrying system, i.e. it can include switching locations for diverting a torpedo towards another part of the system, or for pointing it in another direction, or for temporarily holding it off a main circuit, depending on requirements.

The transportation network of tubes constituted in this way may include electrically-operated valve systems disposed along its length and controlled by coded pulses transmitted through the conductor strips 16, thereby providing means for controlling the speed of camera displacement and optionally for stopping it at a determined location.

The presence of electrically controlled valves at points spaced along a transportation tube makes it possible to use the compressed fluid present in the tube during operation for purposes other than torpedo propulsion, if necessary. For example, such a valve could be used, when necessary, for rapidly inflating an inflatable structure such as a flexible luminescent plastic cylinder which, when inflated, can stand up to constitute a warning marker at a point close to an accident.

Likewise, relays responding to the passage of the camera as it moves can be used to determine the location thereof, for example by transmitting coded pulses to the central control station via the conductor strips 16.

The invention is not limited to the example or examples described above, and it extends to any variant which falls within the scope of the accompanying claims.

Thus, in some cases the signals emitted by the camera could be transmitted by infrared radiation or by ultrasonic waves.

The invention may be used on any location where surveillance needs to be performed over distances which are difficult to cover using a stationary camera (even if it has a wide-angle lens), with the particular means used for propelling the camera along the inside of the transportation tube being adapted to meet the needs of any given installation, and in particular the distances over which the camera is to be moved.

Thus, in large-area public premises networks of rectilinear tubes may be set up, in which case the camera may be propelled by cable or by a rotary lead screw. If such networks include curves, then propulsion may be provided by means of a fluid which is at a higher pressure on an upstream side than on a downstream side of the camera, with the speed of displacement obtained in this way depending on the density and the viscosity of the fluid, with higher speeds being obtained with gaseous fluids such as air, and with air being generally the most appropriate drive fluid for long distance networks, such as may be used for road network surveillance.

We claim:

1. A moving video surveillance system comprising: a horizontal transportation tube, vertically diametrically opposed respective prismatic longitudinally-extending rails running along respective tube generator line internally thereof, a video camera provided with an infrared detector and displaceable along various three-dimensional axes inside said transportation tube, matching slots provided in the peripheries of first and second disks situated at opposite ends of a torpedo, means mounting said camera on said torpedo, said disks engaging said rails respectively and being constituted by a rigid self-lubricating material and in a snug, slidable fit inside the tube.

2. A system according to claim 1, wherein the optical axis of the camera is parallel to the longitudinal axis of the camera-carrying torpedo, and a reflecting angle member is disposed so as to have a vertical edge centered on the optical axis of the camera and having symmetrical faces about the axis of the torpedo, thereby providing reflecting surfaces at a suitable angle to enable the camera to simultaneously receive images of objects situated on either side of the transportation tube through the longitudinal transparent plane wall.

3. A system according to claim 1, wherein the disks for guiding the moving torpedo include one or more self-cleaning pads which are kept in contact with the inside face of the transparent plane wall of the tube as the torpedo moves.

4. A system according to claim 1, wherein the camera is moved along the tube by means of a fluid which is at a higher pressure behind the camera than ahead of the camera.

5. A system according to claim 1, wherein the transportation tube is rectilinear and said images received by the camera are transmitted by a laser beam.

6. A system according to claim 1, wherein the transportation tube in which the camera-carrying torpedo moves is provided on at least one side with a transparent plane wall extending over the horizontal plane containing the tube axis and running along generator lines of the tube, said transparent plane wall being sealed along opposite edges a in continuous manner with the periphery of the tube.

7. A system according to claim 6, wherein respective perforated pipes run along the top and bottom outside edges of the transparent plane wall, with the holes through the pipes being small and numerous, and cleaning material injected into said pipes under pressure, in such a manner as to project a fine spray of cleaning fluid onto the outside surface of the transparent plane wall.

* * * * *